US007403722B2

(12) United States Patent
Triplett

(10) Patent No.: US 7,403,722 B2
(45) Date of Patent: Jul. 22, 2008

(54) INTEGRATED MEDIA AND MEDIA TRAY SENSING IN AN IMAGE FORMING DEVICE

(75) Inventor: Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 312 days.

(21) Appl. No.: 11/062,401

(22) Filed: Feb. 22, 2005

(65) Prior Publication Data

US 2006/0188272 A1 Aug. 24, 2006

(51) Int. Cl.
*G03G 15/00* (2006.01)

(52) U.S. Cl. ..... 399/23; 399/16; 399/389; 399/393

(58) Field of Classification Search ..... None
See application file for complete search history.

(56) References Cited

U.S. PATENT DOCUMENTS

| | | | | |
|---|---|---|---|---|
| 4,730,932 | A | 3/1988 | Iga et al. | |
| 4,951,090 | A | 8/1990 | Matsumoto et al. | |
| 5,081,595 | A | 1/1992 | Moreno et al. | |
| 5,139,339 | A | 8/1992 | Courtney et al. | |
| 5,424,821 | A | 6/1995 | Sampath | |
| 5,463,217 | A | 10/1995 | Sobol et al. | |
| 5,574,527 | A | 11/1996 | Folkins | |
| 5,622,364 | A | 4/1997 | Dutton et al. | |
| 5,652,943 | A * | 7/1997 | Matsuo | 399/21 |
| 5,729,788 | A * | 3/1998 | Hirohashi et al. | 399/66 |
| 5,751,443 | A * | 5/1998 | Borton et al. | 356/446 |
| 5,961,115 | A | 10/1999 | Blanck et al. | |
| 6,018,164 | A | 1/2000 | Mullens | |
| 6,137,968 | A * | 10/2000 | Sunou et al. | 399/23 |
| 6,291,829 | B1 | 9/2001 | Allen et al. | |
| 6,386,669 | B1 | 5/2002 | Scofield et al. | |
| 6,462,822 | B1 | 10/2002 | Haines et al. | |
| 6,590,223 | B1 | 7/2003 | Chelvayohan | |
| 6,599,041 | B1 | 7/2003 | Ahne et al. | |
| 6,600,167 | B2 | 7/2003 | Sano | |
| 6,718,145 | B2 * | 4/2004 | Ohta et al. | 399/16 |
| 6,794,668 | B2 | 9/2004 | Barnes | |
| 6,794,669 | B2 | 9/2004 | Chelvayohan et al. | |
| 6,834,166 | B2 * | 12/2004 | Fujikura | 399/23 |
| 7,073,789 | B2 * | 7/2006 | Suzuki | 271/265.04 |
| 7,274,886 | B2 * | 9/2007 | Suzuki | 399/45 |
| 2003/0021608 | A1 * | 1/2003 | Morita et al. | 399/23 |
| 2004/0047663 | A1 * | 3/2004 | Yano | 399/389 |

FOREIGN PATENT DOCUMENTS

| | | | |
|---|---|---|---|
| JP | 57160843 | A * | 10/1982 |
| JP | 59124640 | A * | 7/1984 |
| JP | 03023963 | A * | 1/1991 |
| JP | 11343048 | A * | 12/1999 |
| JP | 2003300648 | A * | 10/2003 |
| JP | 2004099257 | A * | 4/2004 |
| JP | 2004269233 | A * | 9/2004 |

* cited by examiner

*Primary Examiner*—Daniel J. Colilla
*Assistant Examiner*—'Wynn' Q Ha
(74) *Attorney, Agent, or Firm*—Coats & Bennett, PLLC

(57) ABSTRACT

An image forming device determines a plurality of conditions in the device. In one embodiment, a signal source positioned downstream from a media input tray emits a signal. The signal reflects off of a reflective member and is received by a detector. Based on the amounts of the signal detected by the detector, a controller can determine a media input tray condition and a media sheet condition.

21 Claims, 7 Drawing Sheets

INTEGRATED MEDIA AND MEDIA TRAY SENSING IN AN IMAGE FORMING DEVICE

BACKGROUND

The present invention relates generally to an image forming device, and particularly to devices that determine conditions within the image forming device.

To ensure high quality image formation, precise control of the speed and position of media sheets is required as they are transported along a media path. In addition, many parameters of the image-forming process, such as the media sheet transfer speed, the operating temperature of a fuser, and the like, depend on the type of media. For example, opaque media such as bond paper may require different image formation and fixing parameters than other media, such as transparencies. Hence, it may be necessary that both the position and the type of media sheet (e.g., opaque sheet or transparency) be accurately sensed.

To detect these and other types of conditions, a given image forming device may employ a plurality of media sensors such as electromechanical or optical sensors. For example, a given image forming device may use a first media sensor to detect the media sheet width, a second media sensor to detect the position of a media sheet, and a third media sensor to detect the media sheet type (e.g., opaque sheet or transparency). Still an additional sensor may be used to detect whether a media input tray is in a position to introduce media sheets into the media path.

The number of sensors utilized within the image forming device raises several concerns. Chief among them is the increased costs passed to the consumer. Additionally, a greater number of sensors lead to greater complexity, and thus, the reliability of a given apparatus might suffer. Image forming devices, however, should be constructed in an economical manner without impinging upon reliability. Both cost reduction and improved system reliability may be obtained by integrating the functions of a plurality of media sensors into fewer components.

SUMMARY

Embodiments of the present invention relate to an image forming device operable to determine a plurality of conditions within the image forming device using fewer components. According to one embodiment of the present invention, an image forming device comprises a reflective member associated with a media input tray, for example. The media input tray introduces media sheets into a media path responsive to a pick command. A sensor, which is disposed downstream from the media input tray, emits a signal towards the reflective member. The sensor may receive some portion of the emitted signal reflected by the reflected member, the media sheet that is in the media path, or both. Based on the amount of reflected signal received by the sensor, a controller can determine a plurality of conditions within the image forming device. These include conditions such as whether the media input tray is positioned to introduce media sheets into the path, whether a media sheet is positioned at a predetermined point downstream from the input tray, and the type of media sheet is present at the predetermined point.

DETAILED DESCRIPTION

Figure 1:
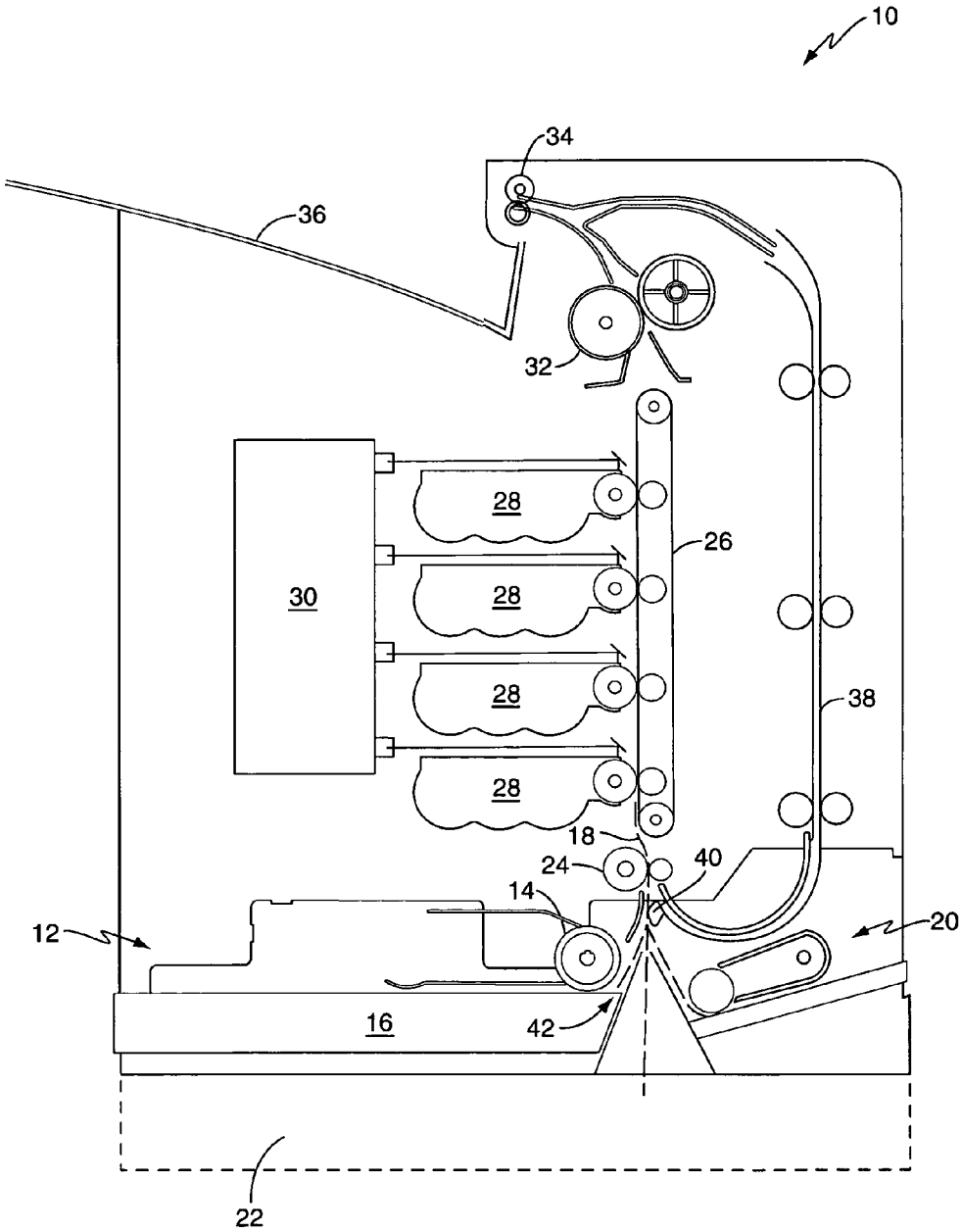
FIG. 1 is a schematic illustration of an image forming device according to one embodiment of the present invention.

FIG. 1 illustrates a representative image forming device, such as a printer, according to one embodiment of the present invention and is indicated generally by the numeral 10. The components and operation of image forming device 10 are conventionally known; however, a brief discussion is included below for clarity.

The image forming device 10 of FIG. 1 includes a first input section 12, a manual input section 20, and optionally, a second input section 22. The first input section 12 includes a media tray 16 having a pick mechanism 14 to introduce media sheets into a media path 18 responsive to the receipt of a pick command. Manual input section 20 may also be located in a main body of the image forming device 10 to introduce media sheets into the media path 18 manually fed by a user. The second input section 22, when present, is also located in the main body of device 10 below the first media tray 16. The second input section 22 may also include a second pick mechanism (not shown) that picks sheets from a media input tray (not shown) responsive to a pick command.

In one embodiment, media input tray 16 is a primary media input tray that holds up to 250 sheets of bond paper, for example. The media input tray in the second input section 22 has a larger capacity than does media input tray 16, and may hold a capacity of 500 sheets. Both media input trays are preferably removable for refilling. Multiple input trays allow for storing multiple types and sizes of media that may be picked and introduced into the media path 18 as required.

In operation, pick mechanism 14 picks an uppermost media sheet from tray 16 to introduce the media sheet into the media path 18. Additionally, media sheets may be manually fed from manual input section 20 or secondary input section 22 as noted above. One or more registration rollers 24 disposed along the media path 18 align the media sheet and control its further movement downstream to receive an image.

In a typical color electrophotographic printer, three or four colors of toner-cyan, yellow, magenta, and optionally black-are applied successively to a print media sheet to create a color image. Correspondingly, the embodiment of FIG. 1 depicts four image formation stations, each including an image formation cartridge 28 arrayed along a media sheet transfer belt 26. During image formation, an imaging device 30 first forms an electrical charge on a photoconductive member (PC drum) within the image forming cartridges 28. A transport belt 26 carries the media sheet successively past the image formation cartridges 28. At each cartridge 28, imaging device 30 forms a latent image onto the PC drum. The latent image is then developed by applying toner to the PC drum. The toner is subsequently deposited on the media sheet as it is conveyed past the image formation cartridges 28.

Once the media sheet moves past the cartridges 28, a fuser 32 thermally fuses the loose toner to the media sheet. The sheet then passes through reversible exit rollers 34, to land facedown in the output stack 36 formed on the exterior of the image forming 10. Alternatively, the exit rollers 34 may reverse motion after the trailing edge of the media sheet has passed the entrance to a duplex path 38, directing the media sheet through the duplex path 38 for the printing of another image on the opposite side of the media sheet. It should be understood that while this description applies to a color electrophotographic printer of FIG. 1, the present invention is not limited to color printers, but may be advantageously applied to other types of image forming devices 10.

As previously stated, conventional image forming devices include a plurality of sensors, each of which are used to sense a different condition within the image forming device 10. For example, some image forming devices may use a first sensor to determine whether input media tray 16 is positioned to introduce media sheets into media path 18, and a second sensor to determine the position of a media sheet moving along the media path. Still, a third sensor may be used to determine the type of media sheet that is moving along the media path (e.g., opaque media or transparent media). The present invention, however, integrates the functionalities of these several sensors into a single sensor 40.

In one embodiment of the present invention, sensor 40 is an optical sensor, such as the sensor described in co-pending U.S. application Ser. No. 10/798,127, which is incorporated herein by reference in its entirety. However, the present invention may utilize any type of sensor known in the art. Sensor 40, which will be described in more detail later, may be positioned at a predetermined point adjacent the media path 18 and downstream from the media input tray 16. In one embodiment, sensor 40 includes an optical source to emit optical energy towards a reflective member 42 associated with media input tray 16. Reflective member may be, for example, a piece of reflective tape adhered to a surface of media input tray 16. The reflective member 42 reflects the optical energy emitted by the optical source towards an optical detector associated with sensor 40.

The amount of optical energy received by the optical detector will vary depending upon a number of conditions. These include, for example, whether the media input tray 16 is positioned to introduce media sheets into the media path 18, whether a media sheet is positioned at the predetermined point along the media path 18, and the type of media that is positioned at the predetermined point. Each of these conditions may be associated with an amount of received optical energy that may be read from sensor 40 by a controller in image forming device 10. The controller uses the amount of optical energy to determine the appropriate condition, and control image forming device 10 accordingly.

Figure 2:
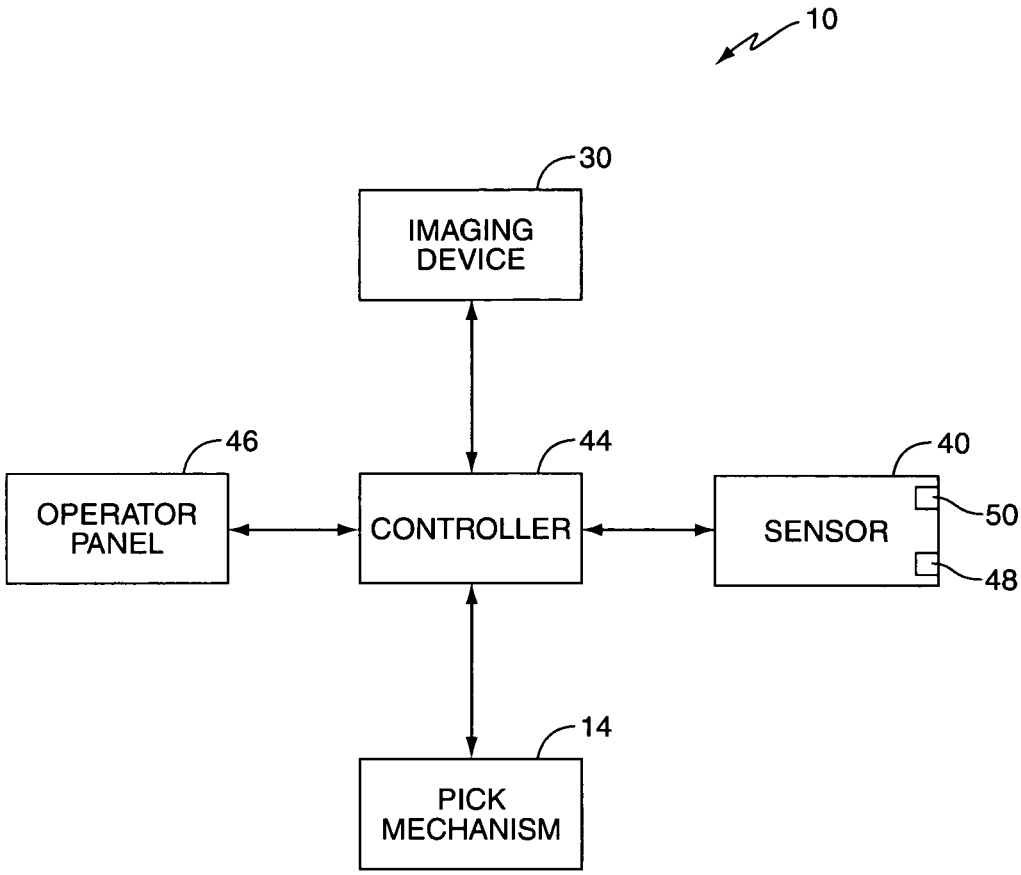
FIG. 2 is a block diagram illustrating a controller communicatively connected to a media sensor and other components according to one embodiment of the present invention.

In FIG. 2, for example, a controller 44 is in communication with sensor 40, imaging device 30, pick mechanism 14, and operator panel 46, according to one embodiment of the present invention. In this embodiment, sensor 40 comprises a unitary device having an optical source 48 and an optical detector 50. In general, the optical source 48 may generate a color or intensity of light. The optical source 48 may generate monochromatic and/or coherent light, such as for example, a gas or solid-state laser. Alternatively, the optical source 48 may emit non-coherent light of any color or mix of colors, such as any of a wide variety of visible-light, infrared or ultraviolet light emitting diodes (LEDs) or incandescent bulbs. In one embodiment, optical source 48 generates optical energy in the infrared range, and is most preferably an infrared LED.

Optical detector 50 may comprise a sensor or device operative to detect and quantify the optical energy emitted by optical source 48. For example, optical detector 50 may comprise a photodiode, and in one embodiment, comprises a phototransistor. As silicon phototransistors are generally more sensitive at infrared wavelengths, an infrared LED optical source 48 and a silicon phototransistor optical detector 50 are presently preferred components, although the present invention is not limited to these elements.

Controller 44 may be, for example, a single microprocessor or multiple microprocessors configured to generally control the operation of image forming device 10. Further, controller 44 may also be configured to determine conditions in image forming device 10 based on the amounts of optical energy detected by sensor 40. For example, controller 44 may determine that media input tray 16 is not positioned to introduce media sheets into media path 18. That is, media input tray 16 may be missing or not seated correctly into image forming device 10 such that pick mechanism 14 cannot introduce an uppermost sheet into the media path 18. In these cases, controller 44 can use the determined condition to display a message on operator panel 46. In another example, controller 44 may determine that a media sheet is (or is not) positioned at a predetermined location along the media path 18. If a media sheet is positioned at the predetermined point, controller 44 may determine what type of media sheet is present and set various operating parameters in the image forming device such as, but not limited to, optimal fusing temperatures, toner amounts, and media sheet speed variation. FIGS. 3-6 illustrate sensor 40 as it might operate to detect varying conditions within image forming device 10, and provide controller 44 with indications of detected conditions according to one embodiment of the present invention. Broadly, sensor 40 includes a housing 52 that contains both optical source 48 and optical detector 50. Optical source 48 emits optical energy $S_E$ towards reflective member 42 on media input tray 16. Reflective member 42 reflects optical energy $S_R$ towards the optical detector 50. In some embodiments, a blocking member 54 may be positioned to inhibit at least some of the optical energy emitted by optical source 48 from reaching optical detector 50. Controller 44 reads the amount of optical energy $S_R$ that is received by the optical detector 50, and determines the appropriate condition.

Figure 3:
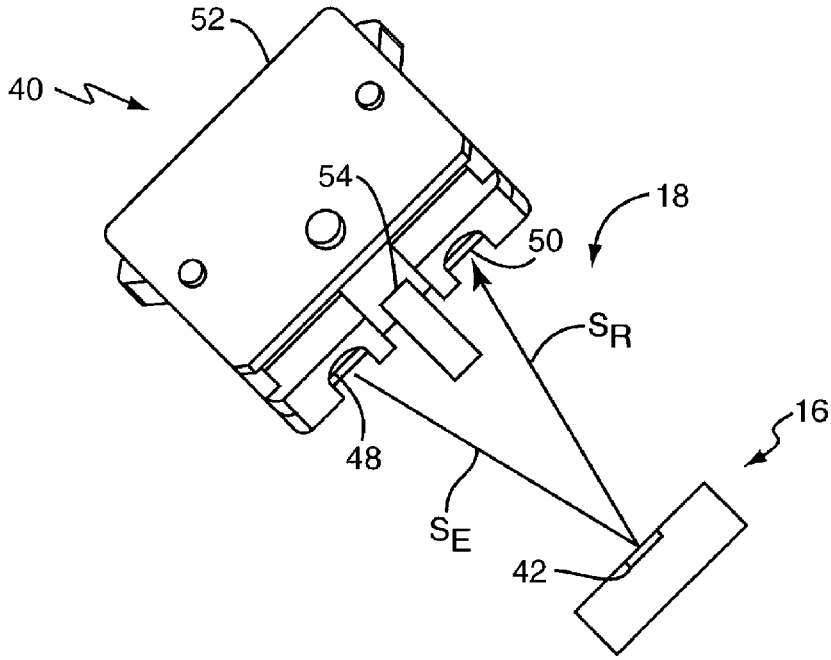
FIG. 3 illustrates a media sensor and a media input tray according to one embodiment of the present invention, wherein no media is present in the media path.

FIG. 3, for example, illustrates how sensor 40 might detect a condition where no media sheets are positioned in the media path 18 according to one embodiment of the present invention. As seen in FIG. 3, the optical energy $S_E$ crosses media path 18 and is reflected by reflective member 42 towards optical detector 50. With no media sheet present in the media path 18, the amount of reflected optical energy $S_R$ detected by optical detector 50 is substantially the same amount as was emitted. Controller 44 could read this level of received optical energy $S_R$ as a high signal level, for example, and determine that no media sheet is present in the media path 18.

Figure 4:
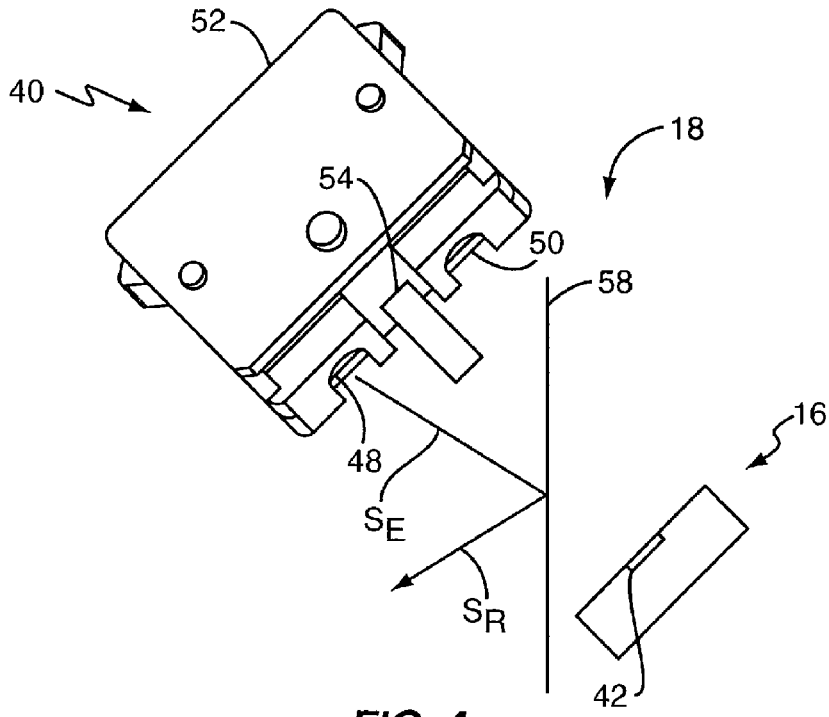
FIG. 4 illustrates a media sensor and a media input tray according to one embodiment of the present invention, wherein a media sheet is present in the media path.

FIG. 4 illustrates how sensor 40 might detect a condition where a media sheet 56, and more particularly an opaque media sheet such as bond paper, is positioned in the media path 18. As seen in FIG. 4, most of the optical energy $S_E$ emitted by optical source 48 will be reflected from a surface of the media 56, or alternatively absorbed by the media 48. Additionally, blocking member 54 could prevent some of the optical energy $S_R$ that might be reflected from the media sheet 56 from reaching optical detector 50. Therefore, optical detector will detect very little, if any, optical energy. Controller 44 could read this level of received optical energy $S_R$, which might be zero or substantially zero, as a low signal level. Alternatively, controller 44 could determine this condition from a change in signals levels, which in this example is from high to low.

Figure 5:
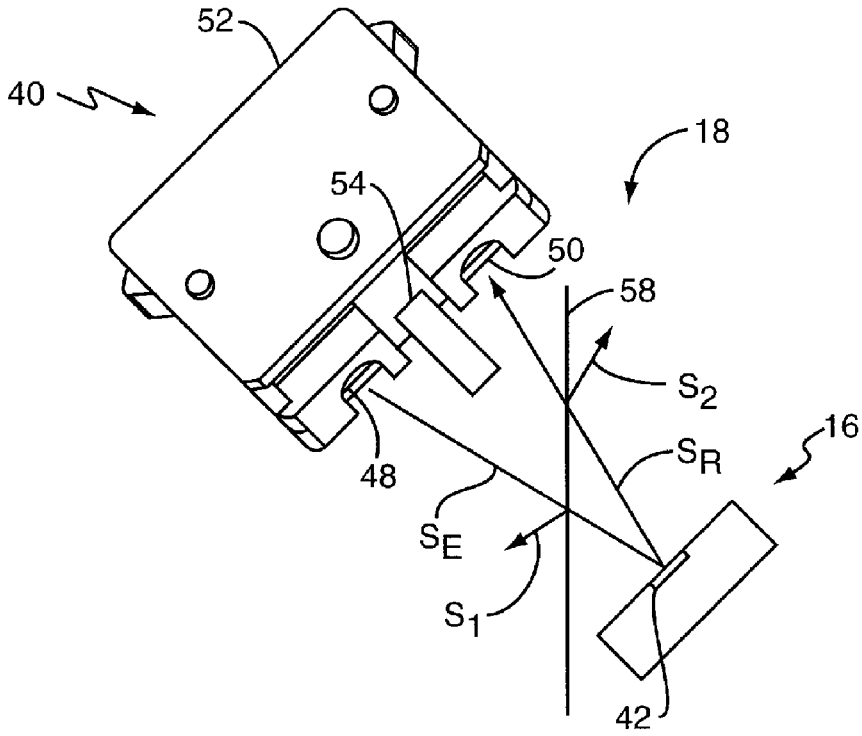
FIG. 5 illustrates a media sensor and a media input tray according to one embodiment of the present invention, wherein a transparent media sheet is present in the media path.

FIG. 5 illustrates an embodiment wherein the media sheet 56 is a transparent media sheet. As referred to herein, transparent media refers to "transparencies," or media sheets commercially available and designed to be used with overhead projections and the like. The term transparent media also includes translucent media. In the case where media sheet 58 in the media path is transparent, some of the optical energy $S_E$ emitted by optical source 48 will pass through transparent media sheet 58 and will be reflected $S_R$ towards optical detector 50. Additionally, some the emitted and reflected optical energies $S_E$ and $S_R$ will be reflected from the surfaces of the transparent media sheet 58, as respectively indicated by the arrows $S_1$ and $S_2$. Assuming that the optical energy is randomly polarized and that the surfaces of the transparent media sheet 58 are smooth, the fraction of emitted optical energy $S_E$ received at optical detector 50 can be calculated using methods known in the art, such as Maxwell's equations and geometrical optics, for example. Generally, the amount of optical energy $S_R$ received at optical detector 50 depends on the angle of incidence of the emitted optical energy $S_E$ with respect to the normal direction of the transparent media sheet 58, as well as the properties of the transparent media sheet 58, including but not limited to the index of refraction, the coefficient of absorption, and the thickness of transparent media sheet 58.

In the embodiment of FIG. 5, the amount of optical energy $S_R$ received at optical detector 50 represents a level that is between the high and low signal levels detected by the embodiment of FIGS. 3 and 4. Controller 44 could read this level of received optical energy $S_R$, and determine that a transparency, for example, is positioned in the media path. Alternatively, controller 44 could determine this condition from the amount of change from a previous signals level.

Figure 6:
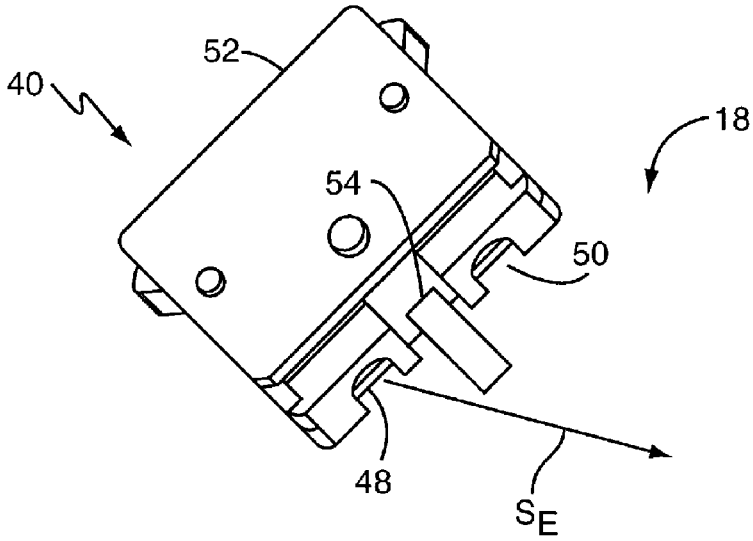
FIG. 6 illustrates a media sensor according to one embodiment of the present invention, wherein the media input tray is not positioned to introduce media sheets into the media path.
Figure 7:
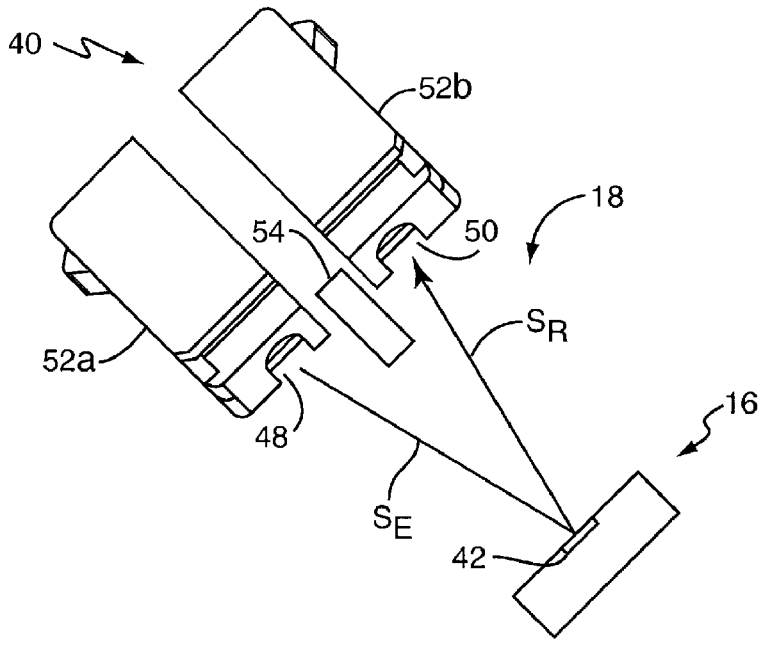
FIG. 7 illustrates a media sensor and a media input tray according to an alternate embodiment of the present invention, wherein no media is present in the media path.
Figure 8:
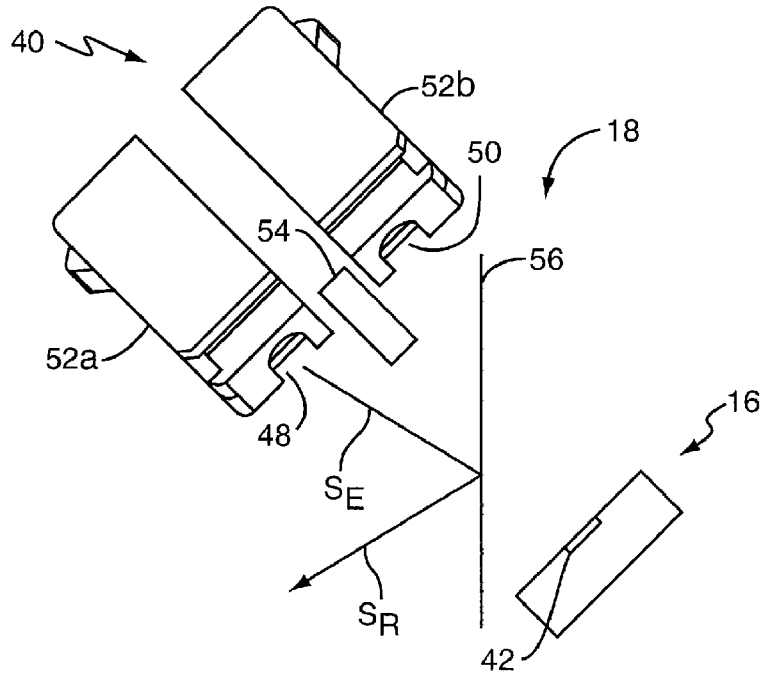
FIG. 8 illustrates a media sensor and a media input tray according to an alternate embodiment of the present invention, wherein a media sheet is present in the media path.
Figure 9:
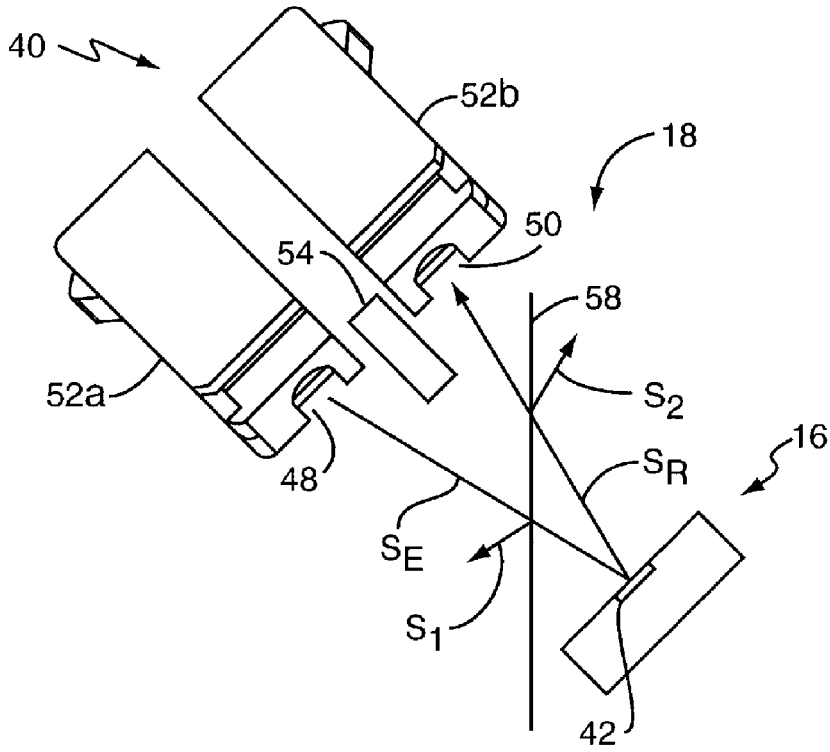
FIG. 9 illustrates a media sensor and a media input tray according to an alternate embodiment of the present invention, wherein a transparent media sheet is present in the media path.
Figure 10:
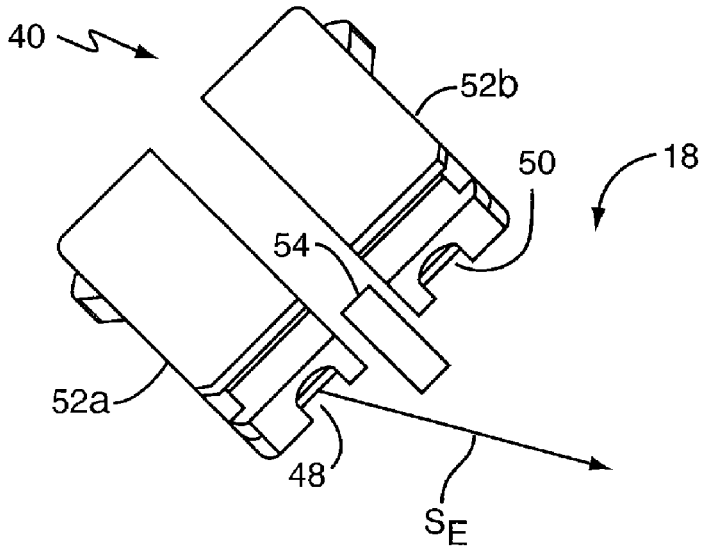
FIG. 10 illustrates a media sensor according to an alternate embodiment of the present invention, wherein the media input tray is not positioned to introduce media sheets into the media path.

FIG. 6 illustrates how sensor 40 might detect a condition where the media input tray 16 is not positioned to deliver a media sheet 56 to the media path. For example, the media input tray 16 may be missing from image forming device 10 entirely, or might be seated in a manner such that it is not operable to introduce media sheets into media path 18. In these cases, reflective member 42 would also be missing, or would not align properly with the optical source 48. Thus, the optical energy $S_E$ emitted by optical source 48 may not be reflected by reflective member 42, or might be absorbed by a surface of media input tray 16 or some other part of image forming device 10. Optical detector 50, therefore, would receive little if any reflected optical energy $S_R$. Controller 44 could then read sensor 40 and determine that the media input tray 16 is missing or seated improperly.

FIGS. 3-6 illustrate an embodiment wherein the optical source 48 and the optical detector 50 are contained within a unitary housing 52. However, it should be understood that the present invention does not require this configuration, nor is it limited as such. FIGS. 7-10, for example, illustrate an alternate embodiment of the present invention where the optical source 48 and optical detector 50 are contained within separate housings 52*a* and 52*b*, respectively. Separating the optical source 48 and the optical detector 50 could permit greater latitude for placement of the optical source 48, optical detector 50, and reflective member 42 within image forming device 10. However, although contained in separate housings 52*a* and 52*b*, the operation of sensor 40 would be substantially the same as that described above with respect to FIGS. 3-6.

As noted above, optical detector 50 could receive varying amounts of optical energy depending upon different conditions. Thus, optical detector 50 and/or controller 44 could be configured to determine each different condition based on the detection of a corresponding number of distinct signal levels or changes between signal levels. However, to reduce complexity, some embodiments of the present invention employ other indicators to determine which condition is being sensed.

Figure 11:
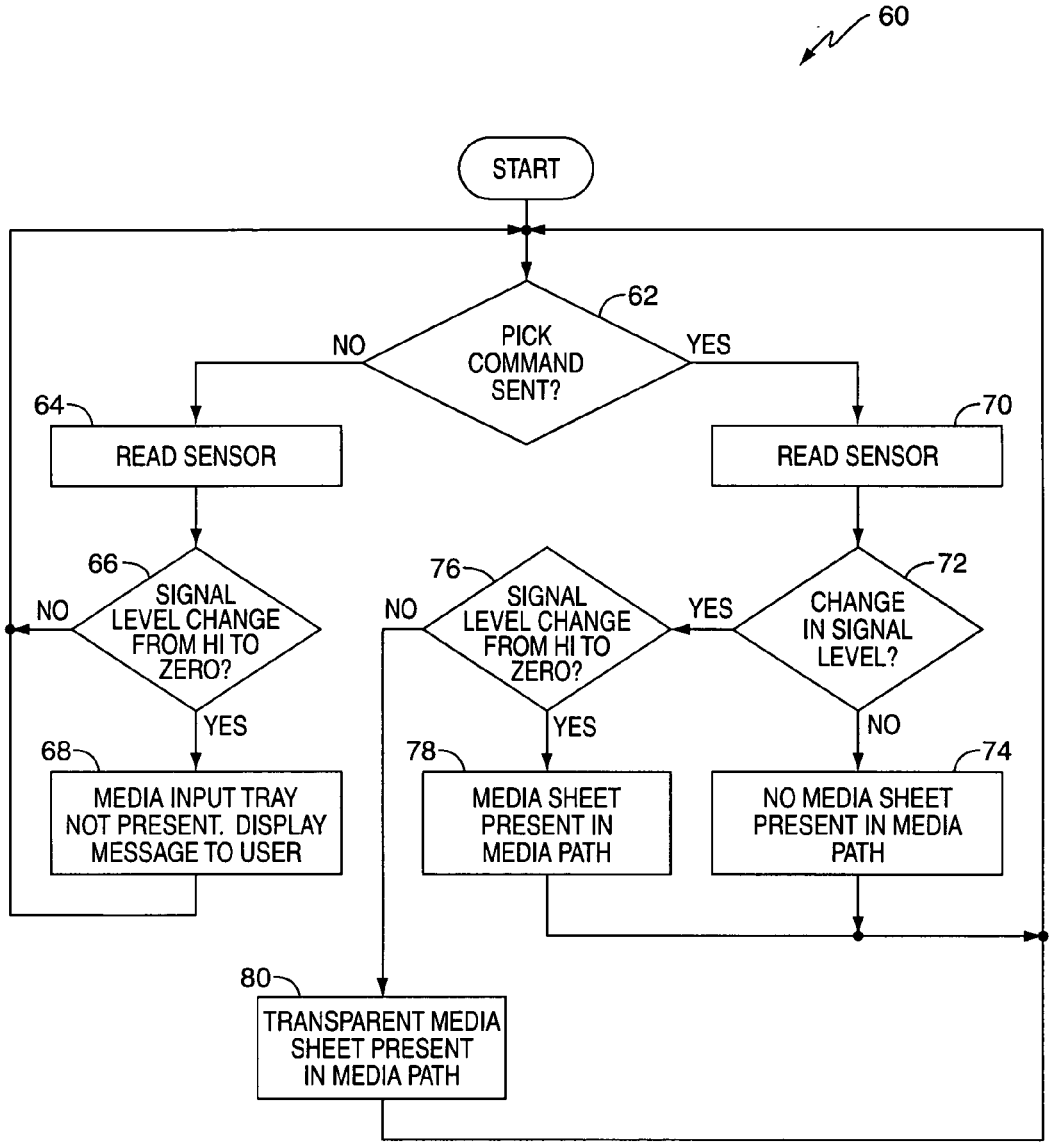
FIG. 11 is a flow diagram illustrating the operation of the controller and the media sensor according to an embodiment of the present invention.

FIG. 11, for example, illustrates a method 60 according to one embodiment of the present invention wherein controller 44 reads sensor 40 based on whether a pick command has been sent to pick mechanism 14. This may be accomplished, for example, by controller 44 checking the state of a flag in memory (not shown) that is set whenever a pick command is sent to image forming device 10. Knowing whether a pick command has been sent allows controller 44 to distinguish between different conditions that may cause similar signal levels to be received at optical detector 50. For example, as seen in FIGS. 4 and 6 (and FIGS. 8 and 10) two different conditions—one where a media sheet 56 is positioned in the media path 18 and the other where the media input tray 16 is missing—could result in the optical detector 50 receiving very little, if any, reflected optical energy $S_R$.

Therefore, method 60 begins with controller 44 first determining whether a pick command has been sent to pick mechanism 14 (box 62). A pick command would mean that the pick mechanism 14 has introduced (or will introduce) an uppermost media sheet into the media path 18. Conversely, no pick command means that no media sheet has been (or will be) introduced into the media path 18, and thus, controller 44 would not need to determine whether a media sheet was in media path 18. In this latter case, controller 44 could read sensor 40 to determine the amount of optical signal received by optical detector 50 (box 64). If the signal level is low, or if the signal level has changed from a high level to a low level (box 66), for example, controller 44 could determine that the input media tray 16 is not in a position to introduce media sheets into the media path 18. In response to this condition, controller 44 might cause a message to be displayed on the operating panel 46 (box 68). If, however, the signal received by optical detector 50 remains at substantially the same level (box 66), controller 44 could determine that the media input tray 16 is in a position to introduce media sheets into media path 18.

If controller 44 determines that a pick command has been sent (box 62), controller 44 would read sensor 40 (box 70) to determine whether there has been a change in the received signal level (box 72). Provided there was no change in signal level or the received signal level remains at a predetermined level, controller 44 could determine that no media sheet is present in the media path (box 74). Alternatively, a change in signal level (box 72) could mean that a media sheet is present at the point in the media path where optical source 48 emits the optical signal $S_E$. Controller 44 could then determine the change in signal level received by optical detector 50 (box 76) to determine whether the media sheet is an opaque media sheet such as bond paper (box 78), or a transparency (box 80). As seen in FIG. 5, the change in received signal level might represent a change from a high signal level to a zero or low signal level.

Thus, controller 44 and/or sensor 40 are configured to detect, according to one embodiment of the present invention, whether the media input tray 16 is positioned to introduce media into media path 18, and whether a media sheet is positioned at a predetermined point along the media path 18 downstream from media input tray 16. In addition, controller 44 and/or sensor 40 may determine what type of media sheet is present at the predetermined point along the media path 18. However, those skilled in the art should readily appreciate that controller 44 and/or sensor 40 of the present invention may detect additional conditions in addition to or in place of those stated above. For example, reflective member 42 could be associated with other components of image forming device 10 including, but not limited to, one or more cartridges 28 or a door panel. Controller 44 could then determine conditions such as whether a given cartridge 28 is properly installed within image forming device 10, or whether the door panel is seated in an operating position. As above, controller 44 could cause messages to be displayed on operating panel 46 if needed to alert the user responsive to these other detected conditions.

Additionally, reflective member 42 is shown in the figures as being one or more pieces of reflective tape adhered to a surface of the media input tray 16. However, in other embodiments of the present invention, reflective member 42 is formed as a recess or cutout having one or more angled and reflective sidewalls. The angles of the one or more sidewalls would be formed to direct the optical energy $S_E$ emitted by optical source 48 towards optical detector 50.

Further, the previous discussion has been in terms of high and low signal levels received by optical detector 50. Those skilled in the art should realize, however, that these quantifications of the received signal levels are illustrative only and not limiting. Any of the illustrative conditions noted above may be determined by sensing changes in signal levels without respect to specific signal level values (e.g., from low to high or from high to low). Additionally, the present invention is not limited solely to using a pick command indication to determine a condition. Any indications available to controller 44 may also be used.

The present invention has also been described wherein controller 44 determines the conditions responsive to the received amounts of optical signals. However, one or more logic circuits and/or software programs communicatively connected to sensor 40 and/or controller 44 may be used to determine the conditions. In these cases, the circuits may determine the condition from the received signal values and provide controller 44 with an appropriate indication thereof.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of detecting a condition within an image forming device comprising:

receiving a media sheet indication from a sensor indicating whether a media sheet is present at a predetermined point along a media path downstream of a media input tray; and receiving a media tray indication from the sensor indicating whether the input media tray is disposed in an operating position.

2. The method of claim 1 wherein the media sheet indication received from the sensor indicates that no media sheet is present at the predetermined point along the media path downstream from the input media tray.

3. The method of claim 1 wherein the media sheet indication received from the sensor indicates that the media sheet is present at the predetermined point along the media path downstream from the input media tray.

4. The method of claim 1 further comprising receiving a media type indication from the sensor indicating a type of media that is present at the predetermined point along the media path.

5. The method of claim 4 wherein the media type indication received from the sensor indicates that the media sheet comprises opaque media.

6. The method of claim 4 wherein the media type indication received from the sensor indicates that the media sheet comprises transparent media.

7. The method of claim 1 wherein the media tray indication received from the sensor indicates that the input media tray is disposed in the operating position in the image forming device.

8. The method of claim 1 wherein the media tray indication received from the sensor further indicates that the input media tray is not installed in the operating position in the image forming device.

9. The method of claim 1 further comprising determining whether a pick command has been sent to the image forming device.

10. The method of claim 9 further comprising receiving the media tray indication when no pick command has been sent to the image forming device.

11. The method of claim 9 further comprising receiving the media sheet indication when the pick command has been sent to the image forming device.

12. A method of detecting a condition within an image forming device comprising:

emitting a signal at a predetermined point downstream from an input media tray;

detecting an amount of the emitted signal based on whether a media sheet is positioned at the predetermined point along the media path; and detecting a different amount of the emitted signal based on whether the input media tray is disposed in an operating position.

13. The method of claim 12 wherein detecting an amount of the emitted signal comprises sensing a first amount of the emitted signal when no media sheet is at a predetermined position along the media path.

14. The method of claim 13 wherein detecting an amount of the emitted signal comprises sensing a second amount of the emitted signal when the media sheet positioned at the predetermined point comprises opaque media.

15. The method of claim 14 wherein detecting an amount of the emitted signal further comprises sensing a third amount of the emitted signal when the media sheet positioned at the predetermined point comprises a transparent media sheet.

16. The method of claim 12 wherein detecting a different amount of the emitted signal comprises sensing a fourth amount of the emitted signal when the input media tray is not positioned to deliver one or more media sheets to receive an image.

17. The method of claim 12 wherein emitting a signal comprises emitting the signal towards a reflective surface associated with the input media tray.

18. The method of claim 17 wherein detecting an amount of the emitted signal comprises detecting the amount of the emitted signal reflected from the surface of the input media tray.

19. A method of detecting a condition within an image forming device comprising:

determining a first condition wherein no media sheet is positioned at a predetermined point downstream from a media input tray based on a first amount of a signal received by a sensor;

determining a second condition wherein a media sheet is positioned at the predetermined point based on a second amount of signal received by the sensor;

determining a third condition wherein the media sheet positioned at the predetermined point is a transparency based on a third amount of signal received by the sensor; and determining a fourth condition wherein the input media tray is positioned to introduce the media sheet into the media path based on a fourth amount of signal received by the sensor.

20. The method of claim 19 further comprising determining whether a pick command has been sent to the image forming device.

21. The method of claim 20 further comprising distinguishing between the second and fourth conditions based on whether the pick command has been sent to the image forming device.

* * * * *